United States Patent [19]

Edelhoff

[11] Patent Number: 4,998,640

[45] Date of Patent: Mar. 12, 1991

[54] PARALLELEPIPEDIC CONTAINER

[75] Inventor: Gustav D. Edelhoff, Iserlohn, Fed. Rep. of Germany

[73] Assignee: Edelhoff Polytechnik GmbH & Co., Iserlohn, Fed. Rep. of Germany

[21] Appl. No.: 371,998

[22] Filed: Jun. 27, 1989

[30] Foreign Application Priority Data

Jun. 27, 1988 [DE] Fed. Rep. of Germany ... 8808225[U]
Jul. 25, 1988 [DE] Fed. Rep. of Germany ..... 3825184
Jul. 25, 1988 [DE] Fed. Rep. of Germany ... 8809465[U]

[51] Int. Cl.[5] ..... B65D 90/02

[52] U.S. Cl. ..... 220/262; 220/323; 220/346

[58] Field of Search ..... 220/315, 262, 323, 329, 220/333, 345, 346, 351

[56] References Cited

U.S. PATENT DOCUMENTS 3,494,219 2/1970 Hillhouse ..... 220/333 X
3,511,188 5/1970 Danielson .
3,524,567 8/1970 Coleman ..... 220/262
4,653,662 3/1987 Wise et al. ..... 220/346 X
4,765,548 8/1988 Sing ..... 220/262 X

FOREIGN PATENT DOCUMENTS 0163859 12/1986 European Pat. Off. .
0235824 9/1987 European Pat. Off. .
200731 11/1907 Fed. Rep. of Germany ..... 220/262
330628 8/1919 Fed. Rep. of Germany ..... 220/262
3039497 10/1980 Fed. Rep. of Germany .

*Primary Examiner*—Joseph Man-Fu Moy
*Attorney, Agent, or Firm*—Morgan & Finnegan

[57] ABSTRACT

A parallelepipedic container, preferably for receiving garbage, comprises an opening which is provided in one end wall and is preferably used in filling the container and which is adapted to be closed by a flap cover. The outer ends of parallel motion links are pivoted to the side edges of the cover and the inner ends of said links are pivoted to pins, which are connected to the side walls of the container. Actuating means are provided for pivotally moving the cover between its closed and open positions. Locking means are provided for locking the cover in its locked position.

4 Claims, 3 Drawing Sheets

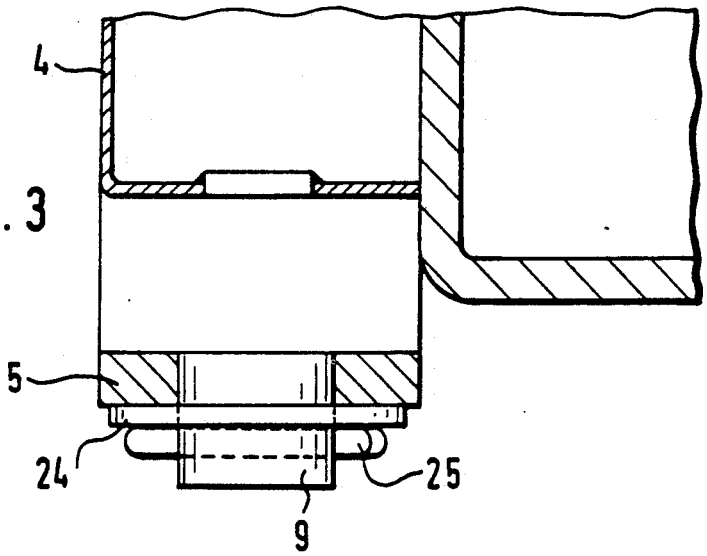
Fig. 3
Fig. 4
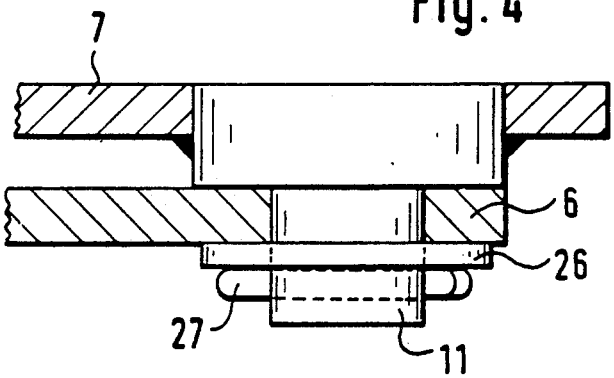

PARALLELEPIPEDIC CONTAINER

This invention relates to a parallelepipedic container having an entrance opening in one end wall and which is preferably used to introduce material into the container and which is adapted to be closed by a flap or a cover. More particularly, the invention relates to a parallelepipedic container having a flap or cover and actuating means comprising motion links pivoted to the side edges of the flap or cover and to the side walls of the container.

BACKGROUND OF THE INVENTION

European Patent Publication No. 163,859 discloses a garbage-collecting truck which is provided with a container of the type generally described hereinbefore. The container serves to receive garbage and is replaceable, being locked by releasable couplings to the chassis of the truck. The truck also includes a pouring unit, which is fixedly connected to the container, as well as conveying and compacting means for feeding the garbage into the container through its entrance opening when the garbage has been charged into the receiving opening of the pouring unit. In the known container the entrance opening can be closed by a shutter which is movable by a hydraulic cylinder, which is a part of the pouring unit and which is provided with suitable pawls and coupling means. The shutter may become canted or may be clamped by objects which are retained in the tracks in which the shutter is moved and guided. Moreover, the shutter cannot be used if there are parts which protrude over the entrance opening, such as protruding lugs or eyelets which are connected to the end wall of the container and serve to couple the container to the truck or other means for moving the same, or similar parts which are disposed in the guide path, tracks or skids on which the shutter is slidable.

European Patent Publication No. 235,824 discloses a container which is of the first kind described hereinbefore and which has an entrance opening that is closed by a flap. The flap is pivoted about a pivot between open and closed positions. In the use of this known container, a relatively large space is required for the movement of the flap and such space may not always be available, particularly when the entrance opening is to be opened or closed when the container is mounted on the garbage-collecting truck.

There exists, therefore, a need for a container which does not exhibit the above-mentioned disadvantages and for this reason it is an objective of the invention to provide such a container which comprises a cover that can move within a small space between open and closed positions.

BRIEF STATEMENT OF THE INVENTION

In accordance with the invention there is provided a container of the kind first described hereinbefore and which comprises parallel-motion links which are pivoted to the side edges of the cover, the inner ends of such links being pivoted to pins connected to the side walls of the container. Actuating means are provided for pivotally moving the cover between its closed and open positions, as well as locking means for locking the cover in its closed position. The parallel-motion links are mounted on pivots which are connected by parallel lines that extend to an oblique angle to the vertical longitudinal center plane of the container and the links together with the cover constitute a four-bar linkage which has two end positions, allowing the cover to be in its open and closed positions, respectively. The cover is guided by the parallel links at four points during its movement. What is properly locked in its closed position the cover can withstand strong forces exerted from inside the container by the contents thereof. Thus accidental opening of the cover of the container during decelerations and accelerations of the carrying truck during the transportation of the container will be avoided.

The container is entirely sealed by the locking means. The cover can move without obstruction between its closed and open positions and will be clear of the plane of the end wall of the container, so that it will be moved above any fixtures which may protrude out of the opening of the container or any means which are mounted on the end wall of the container.

The means for locking the cover may be of any desired or suitable kind and may directly act on the cover of the container or on the parallel-motion links. In the simplest case, the locking means may comprise a locking bolt which extends through locking eyelets or bores.

The actuating means for opening and closing the cover may comprise an arm, by which one of the links is continued beyond the pivot that is mounted on the container.

The links may consist of bell-crank levers. The inner parallel-motion links suitably have outer portions which are parallel to the edge of the cover when it is in its closed position.

In accordance with an optional feature of the invention, the cover has at least one hoodlike bulge, which, when the cover is in its closed position, covers any fixtures which protrude from the opening of the container, such as protruding fixing lugs.

On the other hand, if the container is provided with coupling lugs on eyelets, they are disposed above the cover when it is in its closed position and it is an optional feature of this invention to provide the cover with at least one hoodlike bulge which covers such lugs or eyelets when the cover is in its open position.

Therefore, there is provided, in accordance with the invention, an improved parallelepipedic container adapted for use on a truck, such as a garbage truck, comprising a generally rectangular body having top, bottom, side and end walls, an entrance opening provided in one end wall for introducing material, such as garbage, into the container and which end wall is provided with profiled or shaped edge portions and is closed by a flap or cover provided with side edges, and wherein the improvement comprises providing parallel motion links disposed on the container, the outer ends of the parallel motion links being pivoted to the side edges of the cover and the inner ends thereof being pivoted to pins connected to the side walls of the container, and the parallel motion links forming a four bar locking means for locking the cover in its closed position.

THE DRAWINGS

In order to understand the invention more fully, reference is directed to the accompanying drawings which are to be taken in conjunction with the detailed description of the invention set forth hereinbelow and in which drawings:

FIG. 3 is a sectional view taken along line A-B in FIG. 1 showing the pivotal mounting of a parallel-motion link on the cover; and FIG. 4 is a sectional view taken along line C-D in FIG. 1 showing the pivotal mounting of a link on a side wall of the container.

DESCRIPTION OF THE PREFERRED EMBODIMENTS

Figure 1:
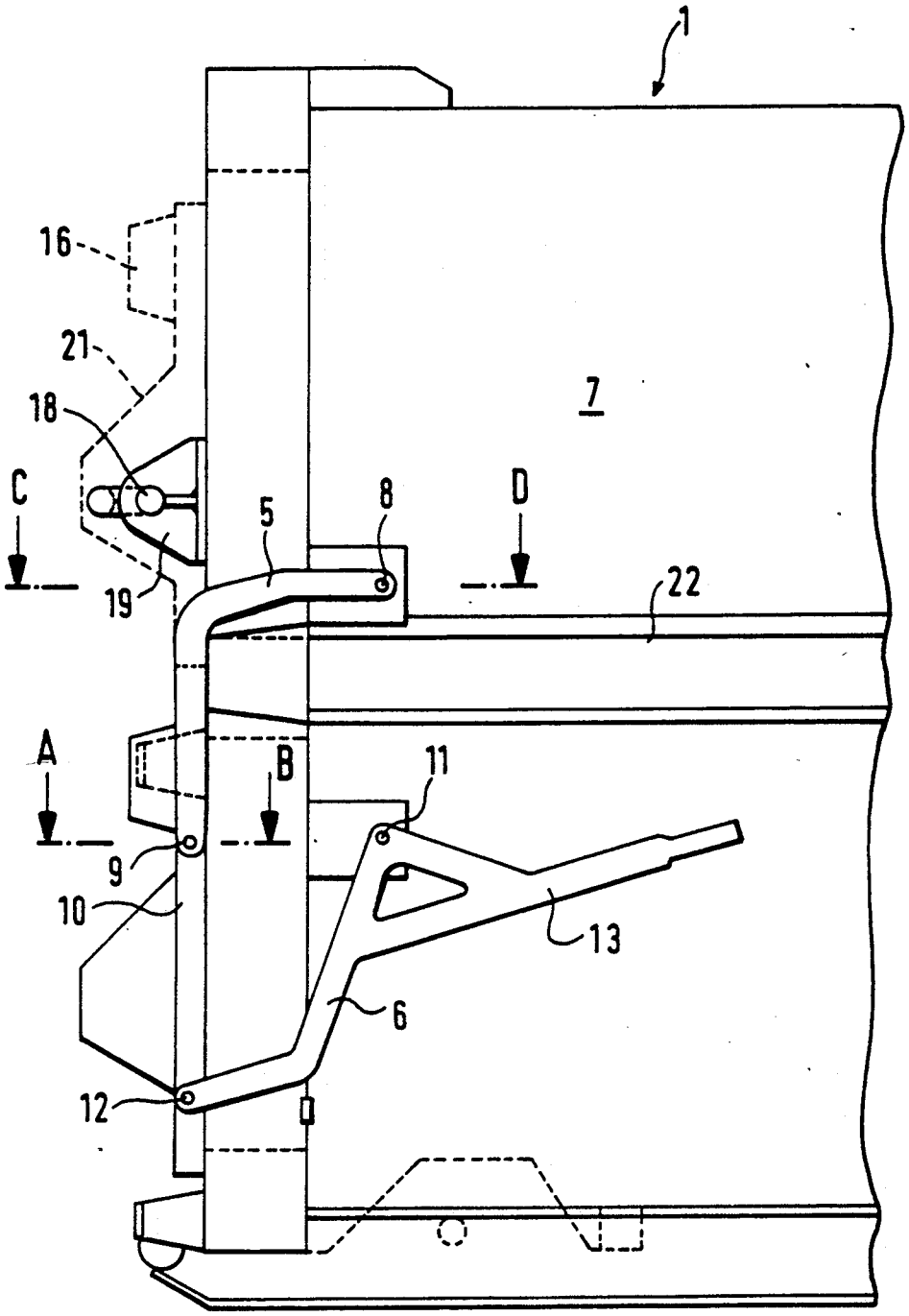
FIG. 1 is a partial side view of a container in accordance with the invention in elevation and partially in section showing the end wall of the container and the cover provided thereon.

Referring now to FIG. 1, there is shown the left-hand side of a parallelepipedic container 1 having an end wall 2 and side walls 7 and 7' and top and bottom walls, 7" and 7"', respectively. The opposite end wall is not shown but is constructed in a manner known, as for example in the above-mentioned European Patents. The container may be replaceable for use on a garbage-collecting truck or the like for receiving garbage. The left-hand end wall 2 of the container 1 is provided in its lower portion with an entrance opening 3, which is indicated by broken lines in FIG. 2. The entrance opening 3 is adapted to be closed by a cover 4, which is rectangular in shape and which is linked to the side walls 7 and 7' of the container by parallel-motion-links 5, 6, 5' and 6'. The inner end portion of the link 5 is pivoted on a pin 8, which is welded to the left side wall 7 of the container. The outer end portion of the link 5 is pivoted on a pin 9, which in its intermediate portion is welded to the profiled or shaped side edge portion 10 of cover 4. The inner end portion of link 6 is pivoted on a pin 11, which is welded to the left side wall 7 of the container. The outer end portion of the link 6 is pivoted on a pin 12, which is provided adjacent to the lower or outer end of the profiled or shaped side edge portion 10 of the cover 4. Links 5' and 6' are similarly disposed on the opposite side of the container on side wall 7' and the opposite profiled or shaped side edge portion of cover 4.

The links 5 and 5' are bell-crank levers. As is apparent from FIG. 1, the outer end portions of the links 5 and 5' extend parallel to the profiled or shaped edge portion 10 and its similar opposite edge of the cover 4 when the cover 4 is in its closed position. The outer arms of the links 6 and 6' are also angled from their inner arms as is shown in FIG. 1. Since the links 5 and 5' and, as well, 6 and 6' are bell-crank levers, the links cannot collide with rails 22, which are mounted on the side walls of the container. When the cover 4 is in its open and closed positions, the bell-crank levers 5 and 5' and 6 and 6' will extend around rails 22.

The link 6 has an arm 13, which extends beyond the pivot pin 11 and serves as actuating means for opening and closing the container 1. Link 6' may also be provided with a like arm so that the cover may be moved to its open and closed positions from either side of the container.

Figure 2:
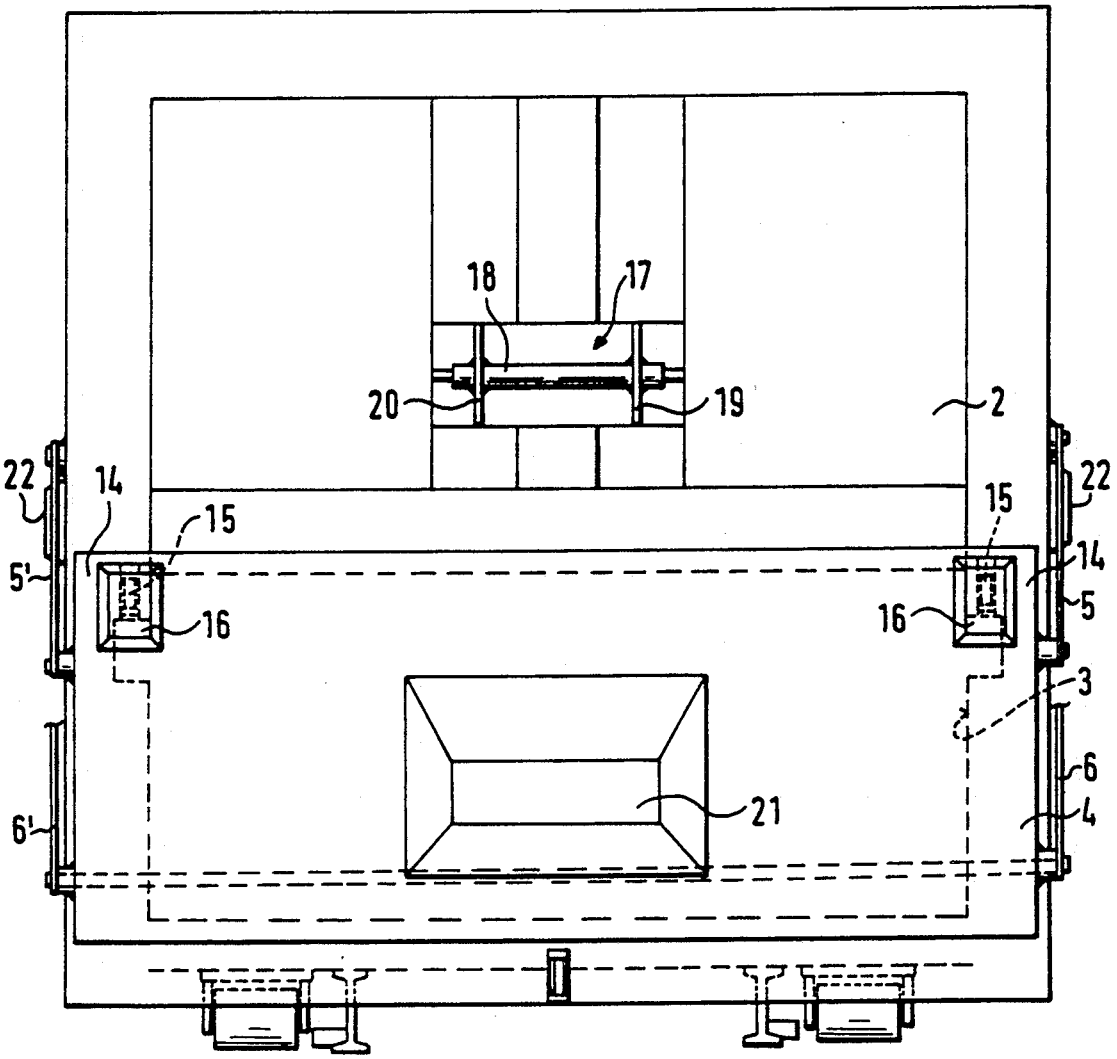
FIG. 2 is a front view of the container shown in FIG. 1, showing the end wall of the container with the cover provided on the entrance opening shown in broken lines.

Besides acting as means for moving the cover to open and closed positions, the parallel motion links form a four bar linkage and also act as locking means to lock the cover 4 when it is in its closed position, as shown in FIGS. 1 and 2.

To ensure that a parallel motion will be imparted to the cover 4 as it moves between its open and closed positions, the pins 8 and 11 and the pins 9 and 12 are spaced equal distances apart. The lines which connect the pins of each pair have such an oblique angle with the vertical longitudinal center plane of the container 1 that the cover 4 will be raised through a sufficiently large distance as it is moved between its closed and open positions.

The profiled side edge portion 14 of the container at the entrance opening 3 is provided with eye lugs 15 in its upper side portions. When the container 1 is locked on a garbage-collecting truck or the like, provided with pouring and compacting means, hooks or bolts provided on the truck extend through these lugs to lock the container 1 to the pouring and compacting means. The cover 4 is formed with tow bulges 16, which are trapezoidal in cross-section and which cover said locking lugs 15 when the cover 4 is in its closed position. The four-bar linkage provided to actuate and lock the cover 4 ensures that during its opening movement the cover 4 will be sufficiently raised about the locking eye lugs 15 so that the cover will move past these lugs without obstruction.

An eyelet 17 is provided on the top portion of the end wall 2 of the container 1. The eyelet 17 comprises a bolt 18, which extends into bores of pronglike lugs 19 and 20 and is welded to these lugs, which are welded to a profiled reinforcing member of the end wall 2. The eyelet 17 is a drag eyelet for handling the container when it is to be loaded to special transport trucks.

The cover 4 is provided with a centrally disposed further bulge 21, which is also trapezoidal in cross-section and which covers eyelet 17 when the cover 4 is in its open position indicated by dotted lines in FIG. 1.

As is apparent from FIG. 3, link 5 is pivoted at its outer end on the pin 9, which is welded to the profiled edge portion of the cover 4. To retain the link 5 on the pin 9, a washer 24 is fitted on the pin 9 and is locked by a cotter pin 25.

The link 6 is similarly pivoted at its inner end on the pin 11, which is welded to the side wall of the container, and the inner end of the link 6 is retained on the pin 11 by a washer 25 and a cotter pin 26.

The present invention provides numerous advantages. For example, the container of this invention has a cover which can move to open and closed positions within a small space. The parallel motion links provide not only an actuating function but also lock the cover in place when it is closed, thus avoiding danger of spillage when the container is subjected to deceleration and acceleration movement when it is disposed on a truck such as a garbage truck. Moreover, the bulges in the cover protect coupling lugs when the cover is in its open position, or protect fixtures, which protrude from the container, such as protruding fixing lugs when the cover is in its closed position. Still further, the container of this invention and its associated structure may be made from readily available materials and due to its simple yet beneficial structure may be readily manufactured in a straight forward manner without the necessity of using complex manufacturing procedures. Numerous other advantages of this invention will be apparent to those skilled in the art.

What is claimed is:

1. In an improved parallelepipedic container comprising a generally rectangular body having top, bottom side and end walls and an entrance opening provided in one end wall for introducing material into said container, and which end wall is closed by a flap or cover provided with side edges, the improvement comprising providing parallel motion links on said container, the outer ends of said parallel-motion links being pivoted to the side edges of said flap or cover and the inner ends of said parallel-motion links being pivoted to pins connected to the sidewalls of said container, actuating means connected to said parallel motion links for pivotally moving the flap or cover between closed and open positions, and said parallel motion links forming a four bar locking means for locking said cover in its closed position, said flap or cover having a hoodlike bulge, which, when the flap or cover is in its closed position, covers any fixtures which protrude from the opening of the container and which may consist of protruding fixing lugs.

2. In an improved parallelepipedic container comprising a generally rectangular body having top, bottom side and end walls and an entrance opening provided in one end wall for introducing material into said container, and which end wall is closed by a flap or cover provided with side edges, the improvement comprising providing parallel motion links disposed on said container, the outer ends of said parallel-motion links being pivoted to the side edges of said flap or cover and the inner ends of said parallel-motion links being pivoted to pins connected to the sidewalls of said container, actuating means connected to said parallel motion links for pivotally moving the flap or cover between closed and open positions, and said parallel motion links forming a four bar locking means for locking said cover in its closed position, said flap or cover having a hoodlike bulge, which, when the flap or cover is in its closed position, covers any fixtures which protrude from the opening of the container and which consist of protruding fixing lugs.

3. In an improved parallelepipedic container comprising a generally rectangular body having top, bottom side and end walls and an entrance opening provided in one end wall for introducing material into said container, and which end wall is closed by a flap or cover provided with side edges, the improvement comprising providing parallel motion links disposed on said container, the outer ends of said parallel-motion links being pivoted to the side edges of said flap or cover and the inner ends of said parallel-motion links being pivoted to pins connected to the sidewalls of said container, actuating means connected to said parallel motion links for pivotally moving the flap or cover between closed and open positions, and said parallel motion links forming a four bar locking means for locking said cover in its closed position, said flap or cover having a hoodlike bulge, which covers coupling means which protrude from the container wall when the flap or cover is in its open position.

4. In an improved parallelepipedic container comprising a generally rectangular body having top, bottom side and end walls and an entrance opening provided in one end wall for introducing material into said container, and which end wall is closed by a flap or cover provided with side edges, the improvement comprising providing parallel motion links disposed on said container, the outer ends of said parallel-motion links being pivoted to the side edges of said flap or cover and the inner ends of said parallel-motion links being pivoted to pins connected to the sidewalls of said container, actuating means connected to said parallel motion links for pivotally moving the flap or cover between closed and open positions, and said parallel motion links forming a four bar locking means for locking said cover in its close position, said flap or cover having a hoodlike bulge, which covers coupling means which protrude from the container wall when the flap or cover is in its open position and which are coupling lugs.

* * * * *